United States Patent [19]

Killer et al.

[11] Patent Number: 4,597,846

[45] Date of Patent: Jul. 1, 1986

[54] DEPASSIVATION LAYER ON AN ELECTRODE OF AN ELECTROCHEMICAL CELL

[75] Inventors: Eric Killer, Wettingen; Günther Scherer, Gebenstorf, both of Switzerland

[73] Assignee: BBC Brown, Boveri & Company, Ltd., Baden, Switzerland

[21] Appl. No.: 625,232

[22] Filed: Jun. 27, 1984

[30] Foreign Application Priority Data

Jun. 28, 1983 [CH] Switzerland ..... 3531/83

[51] Int. Cl.[4] ..... C25B 1/34; C25B 11/04

[52] U.S. Cl. ..... 204/290 F

[58] Field of Search ..... 204/290 F

[56] References Cited

U.S. PATENT DOCUMENTS 3,926,773 12/1975 Koziol ..... 204/290 F
3,933,616 1/1976 Beer ..... 204/290 F
4,326,943 4/1982 Banziger ..... 204/290 F
4,392,927 7/1983 Fabian ..... 204/290 F
4,471,006 9/1984 Asano ..... 204/290 F

*Primary Examiner*—John F. Niebling
*Attorney, Agent, or Firm*—Oblon, Fisher, Spivak, McClelland & Maier

[57] ABSTRACT

A depassivation layer is produced on an electrode for an electrochemical cell by applying one or more layers of a metal salt solution, containing the elements to be applied, to the substrate (1) which is to be coated and is in the form of a porous plate, by means of rolling an elastic roller (2) over the substrate, with the insertion of a solution carrier (3) in the form of felt or paper, and then drying the layer and subjecting it to a chemical/-thermal treatment in air (heat treatment at 450° C.). Good depassivation layers with a relatively small noble metal content can be produced in this way. The depassivation layer which, in the form of a homogeneous film, is at least partially coherent contains, as a finely divided, sub-microscopic mixture, electronically conductive sub-oxides/oxides of the substrate (1) in addition to noble metals/noble metal oxides, and it can also contain further components, such as $SnO_2$.

7 Claims, 2 Drawing Figures

DEPASSIVATION LAYER ON AN ELECTRODE OF AN ELECTROCHEMICAL CELL

Figure 1:
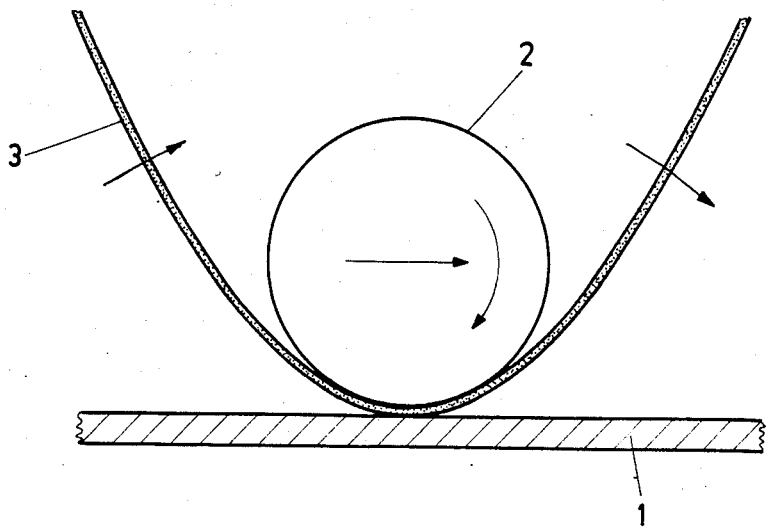

The starting point of the invention is a process for producing a depassivation layer of the generic type of the preamble of claim 1, and a depassivation layer of the generic type of the preamble of claim 2.

The demands which the electrodes of electrochemical cells have to meet are diverse and in some cases contradictory, so that these electrodes must in most cases be built up from composite materials in order to be able to fulfil all the conditions to a reasonable extent. This applies particularly to electrodes (anodes) which must work under oxidising conditions. Normally, a corrosionresistant carrier material is used for such electrodes, which serves as the substrate and which is in turn provided with one or more additional layers of other components. In the case where solid electrolytes are used for the construction of the electrochemical cell, the substrate is constructed from a porous, liquid-permeable and gas-permeable material.

Due to its corrosion resistance, titanium is particularly suitable as the substrate for anodes in industrial electrolysis processes. In this case, the titanium substrate is coated with a specific electro-catalyst, depending on the electrode reaction. The electro-catalyst-/titanium substrate interface is especially critical for the functioning of the electrode. The titanium substrate must be completely covered, since otherwise a non-conductive covering layer, substantially of $TiO_2$, forms under anodic conditions. In order to prevent the formation of this covering layer, an interlayer is frequently applied which consists of a material which is stable in the anodic potential range and is conductive. Noble metals, in particular platinum, are used for this purpose. This interlayer must be coherent, and its thickness can be 0.1–1 μm. Such electrodes provided with interlayers and electro-catalysts are known (A. Nidola, "Technological Impact of Metallic Oxides as Anodes", in "Electrodes of Conductive Metallic Oxides", Part B, page 627, Editor: S. Trasatti, ELSEVIER, Amsterdam, 1981; P.C.S. Hayfield and W.R. Jacob, "Platinum/Iridium-coated titanium anodes in brine electrolysis", in "Modern ChlorAlkali Technology", page 103, Editor: M.0. Coulter, Ellis Horwood Ltd., Chichester 1980, Th. Comninellis and E. Plattner, Journal of Applied Electrochemistry, 12, 399/1982).

Protection of the carrier material (titanium substrate) is of particular importance, whenever the electrocatalyst is applied not as a microscopically coherent layer, but in the form of a porous powder/binder mixture which, due to the porous structure, does not completely cover the substrate. Moreover, the non-passivating interlayer increases in importance, if the titanium substrate is not a solid workpiece, but a porous substrate, for example a sintered titanium foil, such as is used in solid-electrolyte cells. (See, for example: B.V. Tilak, P.W.T. Lu, J.E. Coleman and S. Srinivasan, "The Electrolytic Production of Hydrogen", in Comprehensive Treatise of Electrochemistry, Volume 2, Edited by: J.0.M. Bockris, Brian E. Conway, Ernest Yeager and Ralph E. White, Plenum Press, N.Y. 1981).

In the case of porous titanium substrates, the coating technique is of particular importance, inasmuch as methods, such as are used for planar and solid electrodes, are out of the question in this case. This problem is made even more difficult by the fact that it is desired, for reasons of economy, to apply only the smallest possible quantities of noble metal, 0.1 mg/cm$^2$, but that this is difficult in the case of a relatively undefined surface, such as that of a porous substrate.

The following processes have hitherto been used:

Electrodeposition:

This method requires an extensive pretreatment of the substrate, comprising inter alia degreasing, etching, washing, drying, weighing before and after electrodeposition, and the like. Moreover, the electrochemical deposition of small quantities of a noble metal or of a mixture is difficult in the case of rough or porous samples, since uniform distribution of the platinum nuclei is not obtained. In addition, noble metal is deposited in the interior of a porous sample, where it does not fulfil any depassivation function.

Vapour-deposition:

The vapour-deposition of small quantities of a noble metal or mixture of noble metals is difficult, and the vapour-deposition process is relatively expensive.

Brushing-on or spraying-on a solution, followed by thermal treatment:

These methods are used for planar electrodes. They are, however, unsuitable for porous electrodes, since a substantial proportion of the solution penetrates into the interior of the porous substrate and is thus lost for depassivation.

There is therefore a demand for novel inexpensive depassivation layers and for a cost-reducing process for producing them.

It is the object of the invention to provide a process, by means of which the surface of a porous body can be provided in a controlled manner with a depassivation layer which, coupled with a minimum noble metal content, has improved properties and a high stability and long life.

This object is achieved by the features indicated in the characterising clauses of claim 1 and claim 2.

The invention is described by reference to the illustrative embodiments which are given below and are explained in more detail by means of figures in which: FIG. 1 shows the process by means of a simplifying diagram and FIG. 2 shows a cross-section of the substrate and depassivation layer.

In FIG. 1, the preparation process for producing a depassivation layer is diagrammatically illustrated by means of a simplified device. 1 is the two-dimensional substrate, for example in the form of a porous plate or foil of titanium (longitudinal section). 2 represents an elastic roller which can advantageously consist of "Teflon" (polytetrafluoroethylene). 3 is a two-dimensional, flexible solution carrier which should be porous and absorbent in order to be able to absorb the metal salt solution. It is inserted, in the form of a felt or paper, between the substrate 1 and the roller 2. During the rolling procedure indicated by arrows, 3 releases a thin layer of the metal salt solution to the surface of 1.

Figure 2:
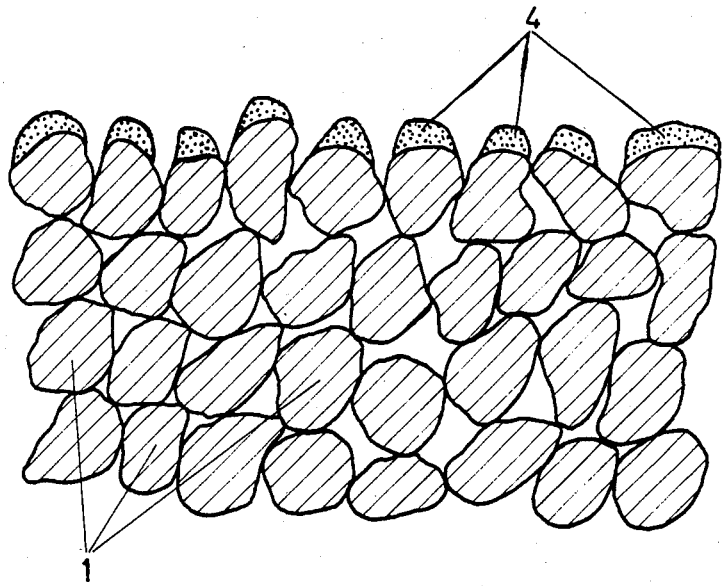

FIG. 2 shows a cross-section through the porous substrate 1 built up from individual grains with interposed voids. 4 is the at least partially coherent depassivation layer in the form of a film, containing a submicroscopically fine, homogeneous mixture of electronically conductive sub-oxides and oxides of the substrate, and of the noble metals or metals originating from the metal salt solution applied, in a metallic and/or oxidic form.

ILLUSTRATIVE EMBODIMENT I

See FIGS. 1 and 2.

A porous sintered titanium plate as the substrate (1) was provided with a depassivation layer (4) which contained platinum. For this purpose, an aqueous $5\times10^{-2}$ N solution of $H_2PtCl_6$ was first prepared. Coating was effected by means of an elastic roller (2) of "Teflon" and a solution carrier (3) in the form of chromatography paper. The coating was carried out by passing the roller over the substrate a total of 5×, the quantity applied being determined gravimetrically each time. The coated titanium plate was then dried and subjected to a chemical/ thermal treatment in the form of heating for 30 minutes at 450° C. in air. The applied quantity of platinum was determined to be 0.1 mg/cm$^2$.

ILLUSTRATIVE EMBODIMENT II

A porous sintered titanium foil as the substrate (1) was coated by a procedure analogous to that of Example I. The metal salt solution consisted of a $5\times10^{-2}$ N solution of $H_2M_cCl_6$, in which formula $M_c$ represented a mixture of Pt and Ir in an atomic ratio of 70:30. The quantity of noble metal was determined to be 0.05 mg/cm$^2$.

The substrates coated in accordance with Examples I and II were tested as current collectors on the anode side of solid-electrolyte cells and, in spite of a noble metal content lower by a power of 10, gave the same cell voltages as electrodes produced by conventional processes (electrodeposition, vapour-deposition).

The invention is not restricted to the illustrative embodiments. Depassivation layers of diverse types and composition can be produced by the novel process. In addition to Ti, suitable substrate materials are Zr, Ta and Nb. In principle, any noble metals can be applied by means of a metal salt solution, both individually and in mixtures. Likewise, further metals which are not noble metals can be added. In addition to noble metals and noble metal oxides (in particular of the platinum metal groups), the finished depassivation layer can also contain gold and a further component in the form of a metal or the oxide thereof, in particular $SnO_2$. A substantial part of the depassivation layer consists of an electrically conductive sub-oxide or oxide of the substrate, or mixtures thereof, produced on the surface during the chemical/thermal treatment. All the constituents listed form a sub-microscopically fine, homogeneous mixture, and the individual components can have dimensions so small that they approach the atomic range. This ensures an at least partially coherent film of the depassivation layer, the film having optimum chemical and physical properties. In this way, the noble metal content of the depassivation layer can be miniwised without having to accept disadvantages, and this has a favourable effect on the economics of the unit.

We claim:

1. An electrode for and electrochemical cell having a depassivation layer, comprising:

a porous metal substrate of a particulate structure, the surface of said substrate being provided with a depassivating layer wherein the top portion of the particles on the outermost layer of the substrate metal particles are coated with a depassivating metal leaving the pores of said outermost layer unfilled with depassivating metal and leaving portions of the particles of the outermost layer uncoated with depassivating metal, said depassivating layer being composed of electrically conductive oxides and/or suboxides of said substrate metal and at least one noble metal and/or noble metal oxide, an the metal of said substrate being at least one of titanium, zirconium, tantalum and niobium.

2. The electrode of claim 1, wherein said noble metal and/or noble metal oxide of said depassivation layer is at least one platinum metal or gold.

3. The electrode of claim 2, wherein said at least one platinum metal is platinum, iridium or ruthenium.

4. The electrode of claim 2, wherein said noble metal oxide is at least one oxide or sub-oxide of at least one of the elements selected from the group consisting of platinum, iridium an ruthenium.

5. The electrode of claim 1, wherein said noble metal is gold.

6. The electrode of claim 1, wherein said surface depassivating layer contains at least one additional metallic and/or oxide component.

7. The electrode of claim 6, wherein said additional metal component is tin oxide.

* * * * *